United States Patent [19]

Reiswig

[11] Patent Number: 4,856,190

[45] Date of Patent: Aug. 15, 1989

[54] SINGLE CUT CLIPPER FOR ARTIFICIAL NAILS

[76] Inventor: Gary J. Reiswig, 17190 SW. 131st, Tigard, Oreg. 97224

[21] Appl. No.: 201,773

[22] Filed: Jun. 2, 1988

[51] Int. Cl.[4] ..... A45D 29/00

[52] U.S. Cl. ..... 30/29; 30/242

[58] Field of Search ..... 30/26, 29, 27, 208, 30/241–243, 335; 132/73, 75.4, 75.5

[56] References Cited

U.S. PATENT DOCUMENTS 205,088 5/1866 Schwartz ..... 32/75.4

3,838,507 10/1974 Clark ..... 30/242 X 3,855,699 12/1974 Charlett ..... 30/242 X 4,228,585 12/1980 Nelson ..... 30/29

*Primary Examiner*—Douglas D. Watts

*Attorney, Agent, or Firm*—Dellett, Smith-Hill & Bedell

[57] ABSTRACT

A clipper retains an artificial nail within a crescent shaped aperture while a blade reciprocates past the aperture to sever the artificial nail with a desired curvature precisely controlled by suitable orientation of the clipper. One cut is required to bring the nail to its final shape thereby eliminating or greatly reducing subsequent shaping procedures.

11 Claims, 2 Drawing Sheets

SINGLE CUT CLIPPER FOR ARTIFICIAL NAILS

BACKGROUND OF THE INVENTION

The present invention relates generally to finger nail clippers and particularly to clippers for artificial finger nails.

Artificial nails attach to natural finger nails to provide the appearance of long natural finger nails. Artificial nails are typically composed of elongate plastic material such as acetate or styrene with a crescent shaped cross-section similar to a natural nail but much thicker. Artificial nails are first attached to the natural nail and then clipped to length with a series of lateral cuts across the nail to form a rough outline of desired nail curvature. The roughened edge is filed to a smooth continuous curvature and then buffed to complete the process. In the filing step, harmful plastic dust is introduced into the work area. A full set of artificial nails can take two hours to apply.

SUMMARY OF THE INVENTION

In accordance with a principal embodiment of the present invention, a nail clipper includes a nail holder having a crescent shaped aperture to closely receive an artificial finger nail and a straight edged blade slidably mounted in face-to-face relation with the nail holder. The blade reciprocates, driving its edge across the aperture to severe the artificial nail and form with one stroke of the clipper a cut of desired continuous curvature controlled with great precision by suitable orientation of the clipper as the nail is clipped.

In accordance with one aspect of the present invention, the nail holder is interposed between the blade and the finger upon which the artificial nail is attached, thereby protecting the finger tip from the blade's edge, preventing damage to the nail, and enabling selective curvature of the nail.

It is an object of the present invention to provide a clipper which clips an artificial nail to its final shape with a single cut and with selective curvature and therefore minimizes the filing required and plastic dust introduced into the work area.

It is a further object of the present invention to provide a clipper for clipping artificial nails without risk of injury.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

DETAILED DESCRIPTION

Figure 1:
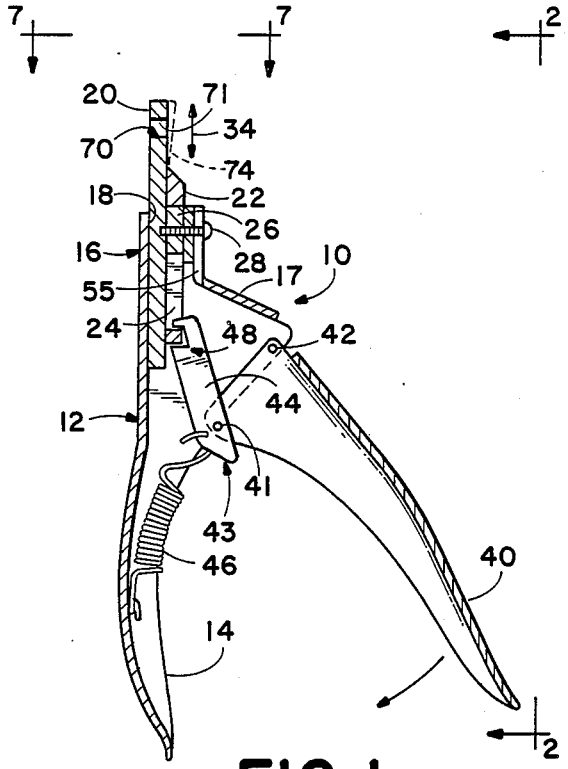
FIG. 1 is a side view in cross section of a nail clipper according to the present invention.
Figure 2:
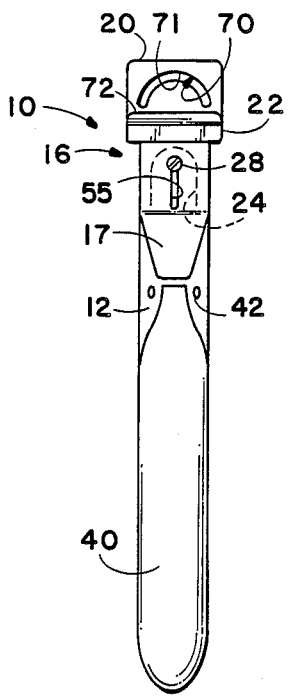
FIG. 2 is a view of the clipper of FIG. 1 taken along lines 2—2 of FIG. 1.

In reference to FIGS. 1–7, an artificial nail clipper 10 includes a clipper body 12 having a stationary handle 14 and a head section 16. In accordance with the present invention, head section 16 forms a rectangular passage 18 in which stationary nail holder 20 and slidable blade 22 are closely held in face-to-face relation. Cover plate 17 and body 12 form an enclosure for the internal mechanism of clipper 10. Blade 22 includes a longitudinal slot 24 in which guide spacer 26 is located and through which a screw 28 passes. Screw 28 inserts through cover plate 17 and head section 16 to thread into hole 29 of holder 20. Tightening screw 28 draws holder 20 against guide spacer 26 and guide spacer 26 against body 12 such that holder 20 and guide spacer 26 are stationary with respect to body 12.

Guide spacer 26 is slightly thicker than blade 22 so that screw 28 may be fully tightened to firmly secure holder 20 and spacer 26 while not binding blade 22 in passage 18. Spacer 26 includes side edges 30 in close proximity to the straight sides 32 of slot 24 to maintain alignment of blade 22 in passage 18 while permitting blade 22 to slide along a path 34. Spacer 26 also forms a stop for blade 22 wherein the length of spacer 26 and the position of hole 27 therein which receives screw 28 determine the range of motion for blade 22 along path 34. Preferably, the range of motion is limited to prevent edge 72 of blade 22 from protruding beyond the distal end of holder 20 as would constitute a hazard.

Movable handle 40 pivots on body 12 about a pin 42 laterally spaced from path 34 extended, while a second pin 41 coupled handle 40 to end 43 of elongated flat link 44 at a point intermediate extended path 34 and pin 42. A spring 46 couples link 44 to stationary handle 14 and biases the link downwardly in a counterclockwise direction in FIG. 1.

Link 44 includes a notch 48 having an upper tongue 50 insertable into slot 24 for coupling to blade 22. Notch 48 defines a pushing edge 52 engaging the lower end 54 of blade 22 and a pulling surface 56 which engages the bottom edge 58 of slot 24. Pivotally closing handle 40 against handle 14 causes pushing edge 52 to contact lower end 54 of blade 22 and drive blade 22 toward a forward position 59 shown in phantom in FIG. 3. Slot 55 in cover plate 17, best seen in FIG. 2, accommodates link 44 as it thrusts into head section 16. As blade 22 moves forwardly, spring 46 and pin 41 provide a coupling force on link 44 to maintain tongue 50 in slot 24. Upon releasing handle 40, spring 46 urges handle 40 away from handle 14 causing pulling surface 56 to engage bottom edge 58 of slot 24 to retract blade 22 from its forward position 59 back to its original position. Thus, handle 40 pivots relative to handle 14 for reciprocation of blade 22 across holder 20.

Figure 3:
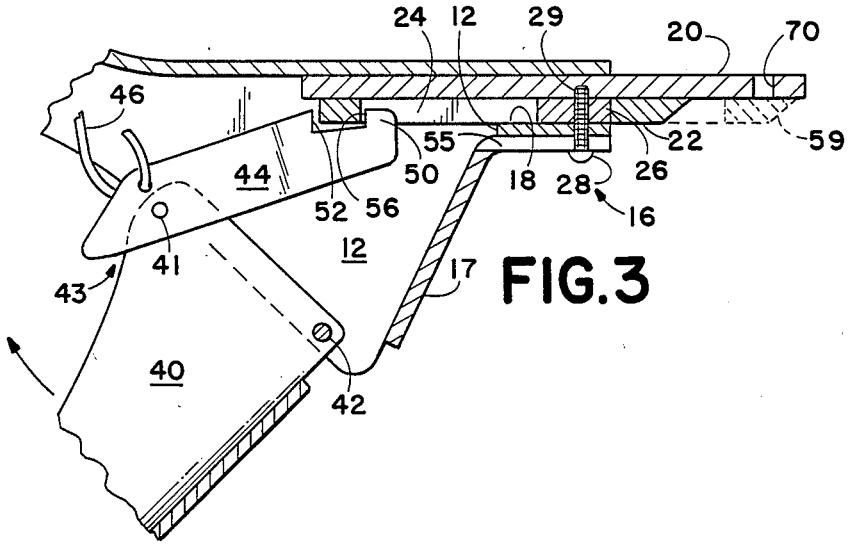
FIG. 3 is an enlargement of a portion of FIG. 1.
Figure 5:
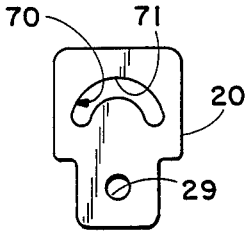
FIG. 5 is a top view of a nail holder used in the clipper of FIG. 1.
Figure 4:
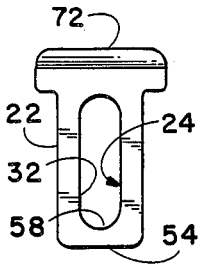
FIG. 4 is a top view of a blade used in the clipper of FIG. 1.
Figure 6:
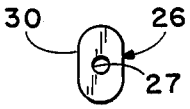
FIG. 6 is a top view of a guide spacer used in the clipper of FIG. 1.
Figure 7:
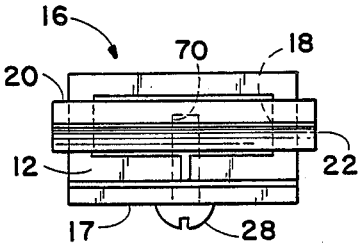
FIG. 7 is a view of the clipper of FIG. 1 taken along lines 7—7 of FIG. 1 and rotated 90° clockwise.

Blade 22 is removed for replacement or repair by first withdrawing screw 28 from holder 20 and body 12. Proximal end 43 of link 44 extends from pin 41 and acts as a release tab for blade 22. Pressure applied at end 43 of link 44 toward handle 14 rotates link 44 in a clockwise manner, as seen in FIGS. 1 and 3, about pin 41 and brings tongue 50 out of slot 24. Blade 22 is then removed from head section 16. A new or repaired blade 22 can be mounted by placement of guide spacer 26 in slot 24 and the new blade 22 in passage 18. Projection 50 inserts in slot 24 by allowing counterclockwise movement of link 44 while screw 28 is passed through guide spacer 26 and threaded into hole 29 of holder 20.

Figure 8:
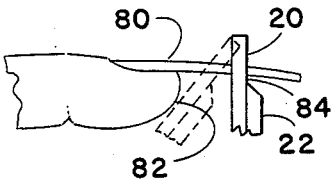
FIG. 8 illustrates use of the clipper of FIG. 1 to clip an artificial finger nail.

Nail holder 20 is provided with a crescent shaped upper aperture 70 adapted to retain artificial nails, said nails being crescent shaped in cross-section. When blade 22 is retracted, i.e., with handle 40 in its open position, aperture 70 is open to permit insertion of an artificial nail therein as depicted in FIG. 8. When handle 40 is then closed and blade 22 is driven toward its forward position 59, straight edge 72 passes over aperture 70 and severs the artificial nail held in the aperture. The precision of cut obtained is improved as blade 22, or at least cutting edge 72 thereof, is held in contact with holder 20. To this end, it has been shown effective to slightly bow holder 20 toward blade 22 as indicated by dotted line 74 in FIG. 1.

The crescent shape of aperture 70 and the straight edge 72 cooperate to center the nail in aperture 70 and produce a clean cut without crushing or bending the artificial nail. Because bight portion 71 of aperture 70 is most forward, the pressure applied to the nail by straight edge 72 tends to centrally position the nail at bight portion 71. If the blade edge were convex, the nail would conform to its shape causing the blade to contact most of the under surface of the artificial nail before cutting the nail. The nail would undesirably crush rather than being cut. If the blade edge were concave, there would be a tendency for the blade to force the nail edges inward, resulting in damage to the nail or a less than optimal cut. Because aperture 70 is crescent shaped, the artificial nail is held in a relatively fixed position and the straight edge 72 of blade 22 contacts the artificial nail at one point on each side of the nail. Holder 20 and blade 22 thus cooperate to sever the nail in a scissor-like fashion, resulting in a clean cut without curling or otherwise damaging the nail. Nails clipped in this manner do not "fly" when cut, eliminating any need for eye protection. Because the nail substantially retains its shape during clipping, prepainted nails may be cut without cracking the paint from the nail.

Figure 9:
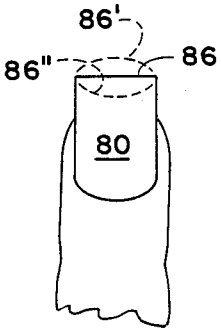
FIG. 9 shows various nails curvatures possible by suitable orientation of the clipper of FIG. 1.

FIGS. 8 and 9 illustrate use of clipper 10 to trim an artificial nail 80 to its final shape. In FIG. 8, nail 80 is placed within aperture 70 through the opposite side of holder 20 from blade 22 and handle 40. Nail holder 20 is thus interposed between blade 22 and finger tip 82, with the operator facing the person being trimmed, while the crescent shape of aperture 70 prevents insertion of finger tip 82 therein. In this manner, the finger is protected from injury when the nail is clipped. Moreover, as indicated, the crescent opening maintains the proper cross-sectional shape of the nail. It will be observed that the illustrated placement of blade 22 on the opposite side of holder 20 from finger tip 82 avoids flattening or curling pressure by the blade against the portion of the nail which remains attached to a person's finger tip, as would occur if the roles of the blade and the holder were reversed.

Rear surface 84 of holder 20, in face-to-face contact with blade 22, is positioned along the length of nail 80 at the desired cutting point. Then, by suitably orienting the angle of holder 20 with respect to nail 80, the curvature of cut is precisely controlled. The location of the relatively straight handle 14 in alignment with holder 20 and on the side toward the person whose nail is being trimmed enables adequate angular movement of the handle in the direction of the person whose nail is being trimmed. When holder 20 is normal to nail 80, as shown in FIG. 8, the forward edge 86 of nail 80 will be square or flat as shown in FIG. 9, but, when holder 20 is tilted as shown in phantom in FIG. 8, forward edge 86' is properly curved. Tipping holder 20 away from finger tip 82 would result in a convex forward edge 86''.

With one cutting operation, each artificial nail can be clipped substantially to its final shape, with a minimum of filing (if any) being required to finish the nail edges. Thus, in some cases the filing step is eliminated and only buffing may be required. Application of an entire set of artificial nails using clipper 10 is accomplished in approximately one hour, as compared to two hours without the clipper according to the present invention. Use of clipper 10 is less hazardous as there is little or no plastic filing dust introduced into the work area.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A clipper for trimming a finger nail comprising:

a clipper body including a first handle;

a second handle opposing the first handle and pivotally coupled to said clipper body;

a planar nail holder having a first side, a second side, a proximal end attached to the clipper body and a distal end, the holder having a crescent shaped aperture with a bight portion thereof extending toward the distal end for receiving the finger nail when inserted from the first side;

a planar blade having a blade edge;

means for retaining the blade in slidable face-to-face relation with the second side of said nail holder; and means responsive to movement of said second handle for sliding the blade from an initial position toward the distal end of said blade holder such the blade edge passes over the aperture in the nail holder and retracts to its initial position.

2. The clipper according to claim 1 wherein said blade edge is straight.

3. The clipper according to claim 1 wherein said sliding means comprises:

a link pivotally connected to said second handle at a point spaced from the connection of said second handle to said clipper body, said link including a latch formation coupling said link to said blade; and spring means coupling said link and said clipper body to urge said blade away from the distal end of said nail holder.

4. The clipper according to claim 1 wherein said second handle is curved away from the line of said clipper body.

5. The clipper according to claim 1 wherein said first handle is substantially aligned with said clipper body and nail holder.

6. Apparatus for clipping a finger nail, said apparatus comprising:

a clipper body;

planar nail holder having an aperture adapted to closely receive the nail to be clipped;

a planar blade slidable in face-to-face relation to said nail holder along a longitudinal path, said blade having a slot parallel to the longitudinal path;

a guide spacer slidably disposed in said slot and dimensioned to resist rotation about an axis perpendicular to a plane containing said blade;

means for securing said guide spacer and said nail holder against motion relative to said body and for securing said blade in face-to-face relation with said nail holder; and means for sliding said blade in relation to said nail holder.

7. The clipper according to claim 6 wherein the aperture in said holder is crescent shaped.

8. The clipper according to claim 6 wherein said blade includes a straight blade edge.

9. The clipper according to claim 6 wherein the slot in said blade includes straight edges and said guide spacer includes straight sides in contact with the straight edges of the slot.

10. The clipper according to claim 6 wherein said sliding means comprises:

a link pivotally connected to said second handle at a point spaced from the connection of said second handle to said clipper body, said link including a latch formation coupling said link to said blade; and spring means coupling said link and said clipper body to urge said blade away from the distal end of said nail holder.

11. The clipper according to claim 6 wherein said securing means comprises fastening means inserted through said clipper body and guide spacer, said fastening means attaching to said holder to secure said holder and said guide spacer against movement relative to said clipper body.

* * * * *

UNITED STATES PATENT AND TRADEMARK OFFICE

CERTIFICATE OF CORRECTION

PATENT NO. : 4,856,190

DATED : August 15, 1989

INVENTOR(S) : GARY J. REISWIG

It is certified that error appears in the above-identified patent and that said Letters Patent is hereby corrected as shown below:

Column 2, line 39, "coupled" should be --couples--.

Signed and Sealed this

Fourteenth Day of August, 1990

*Attest:*

HARRY F. MANBECK, JR.

*Attesting Officer*

*Commissioner of Patents and Trademarks*